US005443025A

United States Patent [19]

Webb

[11] Patent Number: 5,443,025

[45] Date of Patent: Aug. 22, 1995

[54] MULTIPLE CLAMP SYSTEM FOR A COMPUTER CONTROLLED SEWING MACHINE

[76] Inventor: Don W. Webb, 8630 Flagler St., Dayton, Ohio 45415

[21] Appl. No.: 229

[22] Filed: Jan. 4, 1993

[51] Int. Cl.[6] ..... D05B 21/00

[52] U.S. Cl. ..... 112/470.18; 112/114; 112/102.5; 112/470.06

[58] Field of Search ..... 112/104, 114, 121.15

[56] References Cited

U.S. PATENT DOCUMENTS

| | | | |
|---|---|---|---|
| 3,104,637 | 9/1963 | Hedegaard | 112/104 |
| 4,503,789 | 3/1985 | Scholl | 112/121.14 |
| 4,534,303 | 8/1985 | Off et al. | 112/114 |
| 5,094,179 | 3/1992 | Badillo | 112/114 |
| 5,146,859 | 9/1992 | Conley, Jr. et al. | 112/114 |
| 5,377,605 | 1/1995 | Frye | 112/114 |

*Primary Examiner*—Clifford D. Crowder
*Assistant Examiner*—Paul C. Lewis
*Attorney, Agent, or Firm*—Jacox & Meckstroth

[57] ABSTRACT

A garment is clamped against a frame-like feed plate of a computer controlled sewing machine by a clamping frame defining a set of openings of different sizes, and corresponding different size emblems or other patches are held against the garment within the openings by a corresponding set of clamping pads. Stitching gaps are defined within the openings around the pads, and the pads are supported within the openings by corresponding laterally projecting U-shaped inversion arms. The arms carry corresponding pinions which engage a rack operated by a fluid cylinder to provide for simultaneously rotating the inversion arms in opposite directions through 180° to provide for automatically and successively stitching the patches to the garment completely around each clamping pad.

6 Claims, 1 Drawing Sheet

MULTIPLE CLAMP SYSTEM FOR A COMPUTER CONTROLLED SEWING MACHINE

BACKGROUND OF THE INVENTION

In a computer-controlled sewing machine, for example of the type manufactured by Juki Corporation and sold as the Model AMS 220B, a generally rectangular clamping frame is commonly used to clamp a fabric material of a garment against a correspondingly shaped feed plate. The frame and feed plate are supported for movement in X-Y directions on top of the sewing machine table which is located under the head of the sewing machine. The clamping frame is moved in the X-Y directions with the feed plate and also in a Z direction between an upper released position and a lower clamping position by power operated manipulator controlled by a computer program. When the sewing machine is used to stitch an emblem or other patch onto fabric material forming part of a garment, it is desirable to stitch the patch to the material around the entire peripheral of the patch. This stitching operation is performed by placing the patch within the clamping frame, and then clamping the patch to the garment material by a clamping pad. The pad is positioned within the frame which defines a stitching path completely around the clamping pad.

In order to provide for continuous stitching of the patch to the garment around the entire peripheral of the patch, the clamping pad is supported by a U-shaped inversion arm having opposite projecting end shafts rotatably supported by bearings on the clamping pad and a supporting frame, for example, as disclosed in U.S. Pat. No. 5,146,859. The stitching operation is commenced within the U-shaped inversion arm which is rotated 180° as the stitching operation progresses around the peripheral of the patch so that the stitching operation may return to the point where it commenced. The flip-flop rotation of the inversion arm through 180° is produced by either actuation of a rotary solenoid or by moving a rack engaging a gear connected to the inversion arm.

In the rental uniform business, it is frequently desirable to attach multiple different size emblems or other patches to a garment. Usually, the different size patches are attached to the garment by using two separate computer-controlled sewing machines each equipped with a clamping frame and clamping pad for a particular size patch. The use of multiple machines adds significantly to the costs of attaching the patches. It is also known to use interchangeable clamping frames and corresponding interchangeable clamping pads on a single sewing machine. However, down time is required of the sewing machine for interchanging the clamping frames and pads, and this reduces the production rate of the sewing machine. It has also been proposed to use an adjustable clamping pad to accommodate different size patches, for example, as disclosed in above-mentioned U.S. Pat. No. 5,146,859. However, it is apparent that down time of the sewing machine is required to adjust the clamping pad for accommodating a different size patch, and additional time is required to pass each garment through the sewing machine for each patch.

SUMMARY OF THE INVENTION

The present invention is directed to an improved clamp system which is adapted for use on a computer-controlled sewing machine and which provides for quickly and successively attaching a set of emblems or other patches of different sizes or shapes to a fabric or other material forming a garment. In accordance with a preferred embodiment of the invention, a clamp system incorporates a generally flat clamping frame having a set of openings of different sizes or shapes corresponding to the size or shapes of the patches. The frame is supported by an X-Y-Z manipulator or control system of the sewing machine in place of the standard hold down frame. A corresponding set of clamping pads are positioned within the openings and are somewhat smaller than the openings to define an annular stitching gap around each clamping-pad and within the corresponding opening. The clamping pads are supported by a corresponding set of U-shaped inversion arms which project laterally from corresponding bearings on the clamping pads across the stitching gaps to corresponding bearings within an actuator housing. The housing is supported by a separate X-Y-Z manipulator or control system of the sewing machine, and a set of pinions are mounted on the inversion arms within the housing. The pinions are engaged by an elongated rack which is connected to the piston rod of a double acting fluid or air cylinder. When the cylinder is actuated by the control system, the inversion arms rotate simultaneously through 180° in a flip-flop manner so that the stitching operation may continue successively around the entire peripheral of each clamping pad as programmed in the computer-controlled operating system.

Other features and advantages of the invention will be apparent from the following description, the accompanying drawing and the appended claims.

DESCRIPTION OF THE PREFERRED EMBODIMENT

Figure 1:
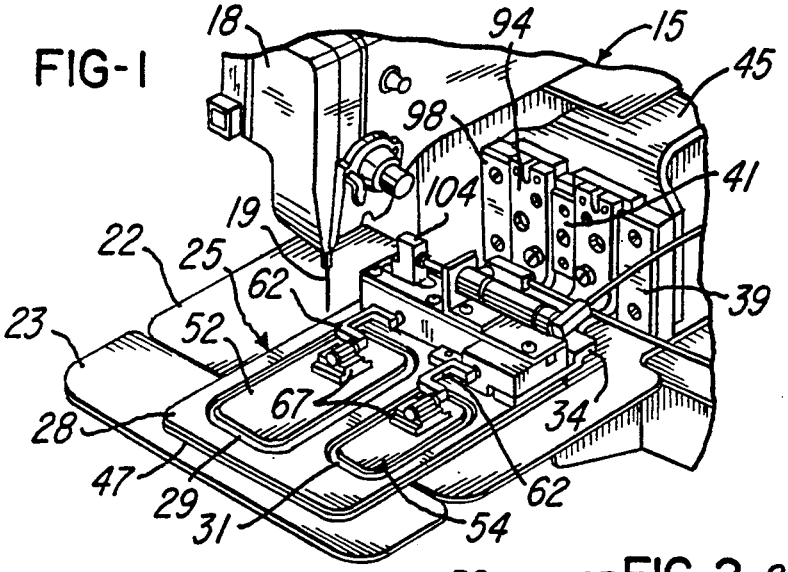
FIG. 1 is a fragmentary perspective view of a computer-controlled sewing machine incorporating a clamp system constructed in accordance with the invention.

FIG. 1 illustrates a programmable or computer controlled sewing machine 15 such as, for example, the Model AM-220 manufactured by Juki Corporation. The sewing machine 15 includes a head portion 18 which supports a needle 19 for vertical reciprocating movement above a stationary table 22 and a vertically movable or retractable cloth plate 23.

Figure 2:
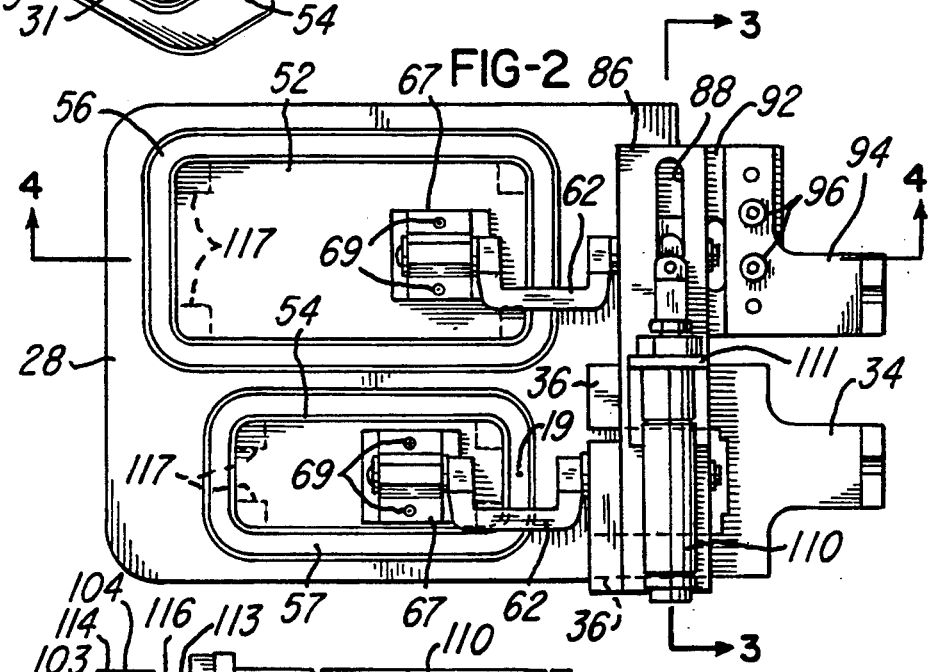
FIG. 2 is a plan view of the clamp system shown in FIG. 1.
Figure 3:
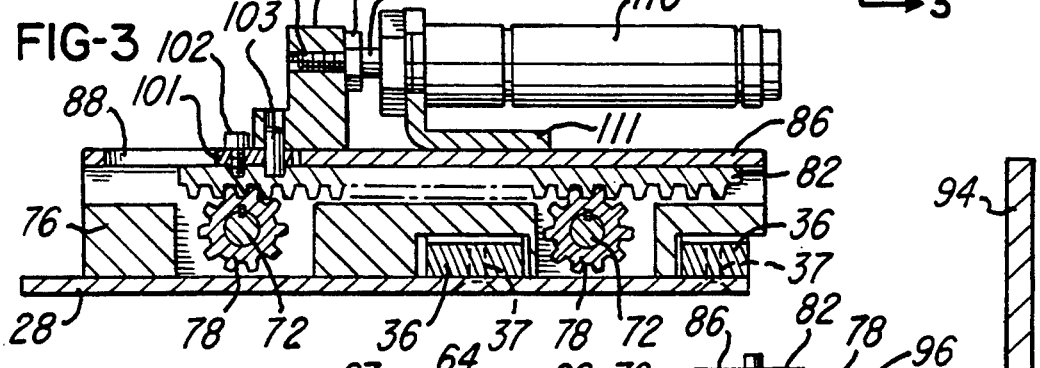
FIG. 3 is an enlarged section taken generally on the line 3—3 of FIG. 2.

In accordance with the present invention, a multiple patch clamp system 25 includes a clamping frame or plate 28 which defines a set of rectangular openings 29 and 31 and is supported by an L-shaped bracket 34 (FIG. 2) having parallel spaced horizontal legs 36 secured to the clamping plate 28 by a set of screws 37 (FIG. 3). The bracket 34 and plate 28 are supported for vertical movement between a set of tracks 39 and 41 (FIG. 1) which are mounted on an arm 45 forming part of an X-Y-Z manipulator or computer controlled actuator system of the sewing machine 15. The clamping frame or plate 28 is positioned directly above a frame-like feed plate 47 which is also connected to the computer controlled actuator system for movement in X-Y directions. The feed plate 47 cooperates with the table 22 and cloth plate 23 to support a portion of a garment formed of fabric or other flexible material while the material is clamped against the feed plate 47 by the clamp system 25 of the invention.

Figure 4:
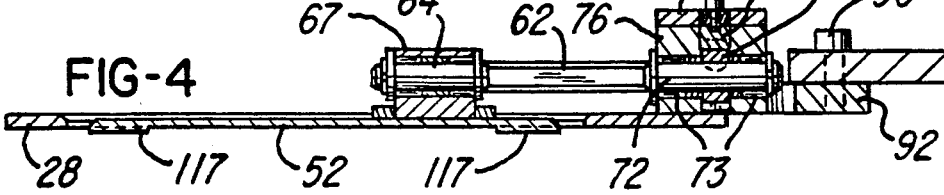
FIG. 4 is an enlarged section taken generally on the line 4—4 of FIG. 2.

Referring to FIG. 2, a corresponding set of clamping pads 52 and 54 are positioned within the openings 29 and 31, respectively, and cooperate with the openings to define stitching paths or gaps 56 and 57 extending around the clamping pads 52 and 54. Each of the pads 52 and 54 is supported within its corresponding opening 29 and 31 by a U-shaped inversion arm 62 having one end shaft portion 64 (FIG. 4) rotatable within a bearing block 67 secured to the clamping pad by a set of screws 69. Each of the inversion arm 62 extends laterally across the corresponding gap 56 or 57 and has an opposite end shaft portion 72 (FIG. 4) which is rotatably supported by a set of bearings 73 within an elongated support housing 76 (FIGS. 3–4).

A gear or pinion 78 (FIG. 3) is secured to the end shaft portion 72 of each inversion arm 62, and the pinions 78 for both inversion arms 62 engage an elongated rack (FIG. 3) 82 slidably supported within the housing 76 above the pinions 78. The rack 82 is confined within the housing 76 by a flat housing cover plate 86 which defines a longitudinally extending slot 88 (FIGS. 2 and 3). Referring to FIG. 4, the housing 76 includes a rearwardly projecting flange 92 which is secured to an L-shaped support bracket 94 by a set of screws 96 (FIG. 2). As shown in FIG. 1, the bracket 94 is supported for vertical movement between the center track 41 and a track 98 secured to the manipulator arm 45.

A block 101 (FIG. 3) is secured to the top surface of the rack 82 by a screw 102 and a pin 103, and the block 101 projects upwardly through the slot 88 to support an L-shape arm 104 slidable on the top surface of the cover plate 86. A double acting fluid or air cylinder 110 is supported by an L-shaped bracket 111 mounted on the housing cover plate 86 and includes an extendable piston rod 113 having an outer end portion 114 threaded into an aligned hole within the arm 104 secured to the rack 82. A lock nut 116 secures the rod 113 to the arm 104. When the cylinder 110 is actuated to extend and retract the piston rod 113, the rack 82 reciprocates within the housing 76 by a sufficient distance to rotate the inversion arms 62 simultaneously through 180°. As shown in FIGS. 2 and 4, each of the clamping pads 52 and 54 has a set of four downwardly projecting corner pads 117 which have knurled bottom surfaces to hold the corresponding patch down to the garment material.

In operation of the clamp system 25 with the computer controlled sewing machine 15, the clamping plate 28 and clamping pads 52 and 54 are elevated in a Z direction by the manipulator arm 45 of the computer controlled actuator system, and the portion of the garment to receive one or more emblems or patches is placed on the feed plate 47. The clamping plate 25 is then lowered by the control system to clamp the fabric or other material of the garment to the feed plate. Either one or a set of emblems or patches are then placed on the garment material within the corresponding openings 29 and 31. The clamping pads 52 and 54 are lowered with the housing 76 and support bracket 94 so that the patch-or patches are clamped to the garment material with an annular portion of the material being exposed through the annular gaps 56 and 57.

The stitching operation with the needle 19 commences within one of the gaps 56 or 57 with the needle located on the rotary axis of the corresponding inversion arm 62, as indicated in FIG. 2. The garment material is then moved by the control system while the material is clamped between the feed plate 47 and clamping frame or plate 28 so that the stitching is performed clockwise around the first selected annular gap 56 or 57. While the stitching operation is being performed by the sewing machine 15, the fluid cylinder 110 is actuated by the control system to rotate or flip the inversion arms 62 by 180° so that the stitching operation may continue uninterrupted back to the position where the needle 19 commenced the stitching operation. Thus the emblem or patch is attached to the garment around the entire periphery of the patch. As soon as one patch is attached to the garment, the clamping frame or plate 28 and feed plate 47 and clamping pads 52 and 54 are shifted laterally and the stitching cycle is repeated around the other clamping pad. If the openings 29 and 31 within the clamping plate 28 do not correspond to the desired locations of the patches on the garment, one patch is attached by the procedure mentioned above and then the clamping plate 28 and clamping pads 52 and 54 are elevated from the feed plate 47. The released garment is then manually shifted laterally to locate the second area of the garment for receiving the second patch within the corresponding opening of the clamping plate 28, after which the clamping and stitching operations are repeated.

From the drawing and the above description, it is apparent that a computer controlled sewing machine equipped with a clamp system 25 constructed in accordance with the present invention, provides desirable features and advantages. As the primary advantage, the clamp system provides for operating the sewing machine so that two different size emblems or patches may be attached to a garment in successive operations with minimum down time of the sewing machine and with each patch attached to the garment around the entire periphery of the patch. In addition, the clamp system is dependable in operation and easy to use and minimizes the handling of each garment while it receives multiple patches. It is also apparent that more than two openings 29 and 31 and corresponding clamping pads 52 and 54 may be used and supported by corresponding inversion arms. 62 rotated by the rack 82 when it is desired to attach more than two different size patches to a batch of garments.

While the form of clamping apparatus herein described constitutes a preferred embodiment of the invention, it is to be understood that the invention is not limited to this precise form of apparatus, and that changes may be made therein without departing from the scope and spirit of the invention as defined in the appended claims.

The invention having thus been described, the following is claimed:

1. A clamp system for use on a computer controlled sewing machine having a surface for supporting a garment and for quickly and successively attaching a set of emblems or other patches of different sizes or shapes to the garment, said clamp system comprising a clamping plate defining a set of openings of different shapes or sizes for receiving the corresponding patches, means supporting said clamping plate for generally vertical movement between an upper position and a lower position for clamping the garment between the clamping plate and the surface, a set of corresponding clamping pads disposed within said openings and adapted to hold the patches against the garment on the surface, each of said clamping pads cooperating with the corresponding said opening to define therebetween a stitching gap extending around each said clamping pad, a corresponding set of inversion arms including U-shaped portions extending laterally across said gaps for supporting said clamping pads, means on said clamping pads for supporting said arms for corresponding rotary oscillatory movement between two positions, means supporting said arms and said clamping pads for generally vertical movement as a unit relative to said clamping plate, means connecting said arms for simultaneous rotation and including a corresponding set of gears connected to said arms, an elongated rack supported for longitudinal movement and engaging said set of gears, and power operated means connected to move said rack longitudinally for oscillating said arms to provide for successively and efficiently stitching the patches onto the garment within said gaps and completely around each of said clamp pads.

2. A clamp system as defined in claim 1 wherein said power operated means connected to move said rack comprise a fluid cylinder.

3. A clamp system for use on a computer controlled sewing machine having a surface for supporting a garment and for quickly and successively attaching a set of emblems or other patches of different sizes or shapes to the garment, said clamp system comprising a clamping plate defining a set of openings of different shapes or sizes for receiving the corresponding patches, means supporting said clamping plate for generally vertical movement between an upper position and a lower position for clamping the garment between the clamping plate and the surface, a set of corresponding clamping pads disposed within said openings and adapted to hold the patches against the garment on the surface, each of said clamping pads cooperating with the corresponding said opening to define therebetween a stitching gap extending around each said clamping pad, a corresponding set of inversion arms including U-shaped portions extending laterally across said gaps for supporting said clamping pads, each of said arms having opposite end shaft portions connected by said U-shaped portion, a support housing, bearing means within said support housing and on said clamping pads for supporting said shaft portions of said arms for corresponding rotary oscillatory movement on generally parallel axes between two positions, a corresponding set of gears united on corresponding said end shaft portions within said support housing, an elongated rack supported within said support housing for longitudinal movement and engaging said gears, and power operated means for moving said rack longitudinally for rotating said set of inversion arms simultaneously to provide for successively and efficiently stitching the patches onto the garment completely around each of said clamping pads.

4. A clamp system as defined in claim 3 wherein said power operated means comprise an air cylinder.

5. A clamp system in combination with a computer controlled sewing machine having a surface for supporting a garment and for quickly and successively attaching a set of emblems or other patches of different sizes or shapes to the garment, said clamp system comprising a clamping plate defining a set of openings for receiving and locating the corresponding patches on said garment, means supporting said clamping plate for generally vertical movement between an upper position and a lower position for clamping the garment between said clamping plate and said surface, a set of corresponding clamping pads disposed within said openings for holding the patches against the garment on said surface with the peripheral edge portions of the patches projecting outwardly from said pads, each of said clamping pads cooperating with the corresponding said opening to define therebetween a stitching gap extending around each said clamping pad, a corresponding set of inversion arms including U-shaped portions extending laterally across said gaps for supporting said clamping pads, means on said clamping pads for supporting said arms for corresponding rotary oscillatory movement between two positions, means supporting said arms and said clamping pads for generally vertical movement as a unit relative to said clamping plate, a corresponding set of gears connected to said inversion arms, an elongated rack supported for longitudinal movement and engaging said gears, and power operated means carried by said supporting means for said arms and said clamping pads and connected to move said rack longitudinally for oscillating said arms to provide for successively and efficiently stitching the peripheral edge portions of the patches onto the garment within said gaps and completely around each of said clamping pads.

6. A clamp system as defined in claim 5 wherein said power operated means comprise an air cylinder.

* * * * *